US006575462B2

(12) United States Patent
Roy

(10) Patent No.: US 6,575,462 B2
(45) Date of Patent: Jun. 10, 2003

(54) MAZE STRUCTURE

(76) Inventor: George C. Roy, 261 Dalhousie Dr., Winnipeg, Manitoba (CA), R3T 2Z2

( * ) Notice: Subject to any disclaimer, the term of this patent is extended or adjusted under 35 U.S.C. 154(b) by 0 days.

(21) Appl. No.: 10/093,414

(22) Filed: Mar. 11, 2002

(65) Prior Publication Data

US 2002/0125634 A1 Sep. 12, 2002

Related U.S. Application Data

(60) Provisional application No. 60/274,653, filed on Mar. 12, 2001.

(51) Int. Cl.[7] ..... A63F 7/00; A63F 9/00

(52) U.S. Cl. ..... 273/153 R; 273/118 R

(58) Field of Search ..... 273/153 R, 109, 273/118 R, 113; 52/239

(56) References Cited

U.S. PATENT DOCUMENTS

| | | | | | |
|---|---|---|---|---|---|
| 572,142 | A | * | 12/1896 | Williams | 472/62 |
| 1,294,013 | A | | 2/1919 | Wittrup | |
| 2,261,804 | A | | 11/1941 | Hall | |
| 3,516,389 | A | * | 6/1970 | Meyer | 119/417 |
| 3,561,757 | A | | 2/1971 | Schillig | |
| 3,785,651 | A | | 1/1974 | Smith | |
| 3,787,054 | A | | 1/1974 | Stafford | |
| D250,286 | S | | 11/1978 | Zelenko | |
| 4,743,023 | A | | 5/1988 | Collier | |
| 4,824,098 | A | * | 4/1989 | Huang | 273/153 R |
| 4,861,036 | A | * | 8/1989 | Watanabe | 273/113 |
| 4,953,502 | A | * | 9/1990 | Hoover | 119/452 |
| 5,054,427 | A | * | 10/1991 | Hoover | 119/452 |
| 5,145,174 | A | | 9/1992 | Caramanoff | |
| 5,219,316 | A | * | 6/1993 | Huffman | 472/62 |
| 5,364,311 | A | * | 11/1994 | Chou | 472/62 |
| 5,393,074 | A | * | 2/1995 | Bear et al. | 273/440 |
| 5,409,223 | A | | 4/1995 | Attaya | |
| 5,499,815 | A | | 3/1996 | Attaya | |
| 5,560,606 | A | | 10/1996 | David | |
| D379,381 | S | | 5/1997 | Hermes | |
| 5,732,945 | A | | 3/1998 | Sofia | |
| 5,839,723 | A | | 11/1998 | Grimes | |

* cited by examiner

*Primary Examiner*—Raleigh W. Chiu
(74) *Attorney, Agent, or Firm*—Ryan W. Dupuis; Adrian D. Battison; Michael R. Williams

(57) ABSTRACT

A maze structure is provided having plural levels, each with a floor and upstanding walls arranged in a maze-like pattern and dividing each level into a plurality of separate chambers. Openings are located in the top and bottom sides of the levels for communication of the chambers of one level with chambers of adjacent levels when the levels are stacked. Having the chambers of adjacent levels being arranged to communicate with one another regardless of the relative orientation of the levels permits any one level to be rotated about a vertical axis in relation to the other levels as well as permitting a plurality of different stacking orders to produce numerous different combinations and different solutions to the maze structure.

25 Claims, 10 Drawing Sheets

MAZE STRUCTURE

This application claims priority benefits of U.S. provisional application Ser. No. 60/274,653, filed Mar. 12, 2001.

FIELD OF THE INVENTION

The present invention relates to a maze structure, and more particularly to a maze structure which is modular in construction so as to permit the maze structure to be rearranged.

BACKGROUND

Mazes are known as an amusement device where participants are challenged to find their way through a series of diverging paths. The maze typically involves a contrived ornamental and complex layout of paths through which a person or maze ball must pass to exit the maze.

The traditional maze through which a person must pass has been an area of a park or a garden or other large outdoor area where the route between the entrance and exit of the maze are interrupted by a series of paths and intersections of paths. Paths may be bordered on both sides by tall shrubbery or other form of visual and physical barrier. These paths diverge, cross and come to dead ends often so as to confuse participants and confound their intention of successfully negotiating through the maze. Other mazes may be housed indoors in a trailer or other building, employing for the borders of its paths any combination of opaque material, glass or other transparent material and mirrors. In either instance the participant must walk through the maze. The route is laid out in only two dimensions, that is length and width, and are thus often simple. Furthermore, these mazes are typically fixed and unchangeable, such that once the route is discovered, the mystery is solved and the maze no longer serves as an amusement device.

A form of naturally occurring maze known to adventurers, are subterranean caves. These caves very often resemble three dimensional mazes which increase the level of difficulty of the maze, with parts of the maze being huge, whereas others are barely small enough to squeeze through. Caves however are often dangerous because of unexpected deep precipices, noxious gases, moving water, falling objects and sharp protrusions. Other caves are so large and complicated or dangerous that they have not been fully explored. Caves are thus often not a desirable method of enjoying a maze even though the added challenge of a three dimensional maze may be desired.

Known maze structures have been provided in three dimensions to increase the level of difficulty of finding ones way through the structure. Three dimensional mazes and puzzles are described in the following U.S. patents which include U.S. Pat. No. 1,294,013 to Wittrup, U.S. Pat. No. 2,261,804 to Hall, U.S. Pat. No. 3,785,651 to Smith, U.S. Pat. No. 3,787,054 to Stafford and U.S. Pat. No. 5,560,606 to David. In each of the prior devices however the maze structure is fixed and thus only one solution is produced. Further three dimensional maze structures are provided in U.S. Pat. No. 4,743,023 to Collier and U.S. Pat. No. 5,839,723 to Grimes. Both Collier and Grimes provide multi-level mazes in which the levels are stacked one above the other, permitting the order of the maze to be rearranged. In both instances however the levels are arranged such that the maze of one level must be completed before passage to the next level is permitted thus offering only a very limited number of possible variations to the solution of the maze as only one aperture is arranged to communicate between adjacent levels in a limited number of relative orientations between the levels.

SUMMARY

According to one aspect of the present invention there is provided a maze structure including:

a base level comprising:
- a floor;
- a plurality of exterior walls extending upwardly from the floor of the base level adjacent a periphery of the floor defining a perimeter of the base level;
- a plurality of interior walls extending upwardly from the floor of the base level within the perimeter defined by the exterior walls of the base level, the interior walls dividing the base level into a plurality of chambers; and
- a top end which is at least partially open;

a plurality of stacking levels, each stacking level comprising:
- a floor;
- a plurality of exterior walls extending upwardly from the floor of the stacking level adjacent a periphery of the floor defining a perimeter of the stacking level;
- a plurality of interior walls extending upwardly from the floor of the stacking level within the perimeter defined by the exterior walls of the stacking level, the interior walls dividing the stacking level into a plurality of chambers; and
- a top end which is at least partially open;

the floor of the stacking level including a plurality of apertures therein, each being arranged to communicate between one of the chambers of the stacking level and one of the chambers of an adjacent level supported therebelow through the at least partially open top end of said adjacent level;

the stacking levels being arranged to be supported one atop the other on top of the base level with each stacking level being arranged to be supported on an adjacent one of the levels therebelow in a plurality of relative stacking orientations therebetween with each of the apertures in the floor of the stacking level being arranged to communicate with one of the chambers of said adjacent one of the levels therebelow through the at least partially open top end of said adjacent one of the levels therebelow in each of the plurality of stacking orientations.

The arrangement of the apertures for communicating between chambers of adjacent levels regardless of the relative orientation of the levels permits any one level to be rotated about a vertical axis in relation to the other levels as well as a plurality of different stacking orders to produce numerous different combinations and different solutions to the maze structure. The further arrangement of plural apertures communicating between each adjacent pair of levels permits a significant amount of interaction between the chambers of one level and the chambers of another level so that variation of the solution to the maze structure is significant even when only minor changes to the relative orientation of the stacking levels is present.

Each stacking orientation may comprise a different order in which the stacking levels are supported one atop the other. Alternatively, each stacking orientation may comprise a different angular position of at least one of the stacking levels in relation to the other levels with said at least one of the stacking levels being rotated about a vertical axis extending through the levels between positions. The different stacking orientations may further comprise a combination of different relative angular positions and stacking orders of the stacking levels in relation to the base level.

The levels preferably have similarly polygonal-shaped floors which are similar in size, a length of each side of each floor being substantially equal to a length of the remaining sides. When the floor is square, each level is permitted to be rotated into four different angular positions in alignment with adjacent levels. In further arrangements, the floor of each level may have any number of sides, with the number of sides determining how many different relative angular positions between two adjacent levels are permitted in order for the levels to remain aligned one atop the other.

When the floor of each level is generally rectangular in shape, the interior walls are preferably all mounted along a rectangular grid on the respective floor. The interior walls are preferably selectively mounted on the grid on the respective floors of the levels such that the interior walls are moveable between various wall mounting positions along the rectangular grid on the respective floor.

Each grid will include a plurality of intersection points with a post preferably being mounted on the respective floor to extend upwardly from each respective intersection point of the respective grids. The posts are preferably arranged to support the walls on the floor with the walls being selectively mountable between any pair of adjacent posts.

A cover is provided in preferred embodiments, arranged to be mounted on an uppermost one of the stacking levels regardless of the stacking orientation of the levels.

A combined height of the levels supported one atop the other may be substantially equal to a width of one of the floors such that the maze structure forms a cube. The cubic shape of the maze structure is desirable when the maze structure comprises a handheld game as the cubic shape permits the maze structure to be very compact and aesthetically pleasing in design.

In a handheld embodiment, a clamping mechanism is preferably provided for securing the levels together. The maze structure can then be handled by a person for guiding a maze ball through the maze structure. The clamping mechanism may be arranged to permit relative rotation of at least one of the stacking levels in relation to the other levels about a vertical axis extending centrally through the levels for displacing the maze structure between the different stacking orientations without disassembling the levels from one another. Rotation of each level in relation to the other levels thus produces a new arrangement of diverging paths from entrance to exit of the maze structure.

There may be provided an entrance aperture through one of the exterior walls of a respective one of the levels and an exit aperture through one of the exterior walls of a respective one of the levels. The apertures are useful for permitting passage of a maze ball therethrough in a handheld embodiment or passage of a person therethrough in maze structure scaled for persons. When a maze structure is scaled for persons, the chambers and the apertures of the respective levels are suitably sized to receive a person therethrough.

In an alternative embodiment of a handheld maze structure, the entrance and exit apertures need not necessarily be provided, but rather a transparent wall in each of the entrance and exit locations with proper indicia may be provided. A maze ball in this instance would be enclosed in the maze structure.

The entrance aperture and the exit aperture are preferably both located on the base level. Preferably there is no communication between the entrance aperture and the exit aperture on the base level. Furthermore, each chamber on any given level is preferably restricted from communication with the other chambers on said given level by the interior walls. The non-communication between chambers and the entrance and exit on the same level increases the level of difficulty and the amount of interaction between levels required to pass between the entrance and the exit of the maze structure.

The interior walls are preferably arranged such that, in at least one of the stacking orientations, the chambers and the apertures communicating between the chambers form a continuous tunnel from the entrance aperture to the exit aperture with no chambers or apertures diverging from the continuous tunnel. This permits the level of difficulty of the maze to be lowered as desired.

In one embodiment, the floor of each level may comprise a plurality of interconnected modular units which are selectively separable from one another, each modular unit having a floor with sides and at least one wall extending upwardly from a respective one of the sides thereof, each of the walls of the respective modular units forming part of the interior and exterior walls of the level.

According to a further aspect of the present invention there is provided a kit of parts for assembly into a maze structure for passage of an object therethrough, the kit comprising:

- a plurality of modular units, each modular unit comprising:
  - a floor which is suitably sized for supporting the object thereon, the floor being an equilateral polygon in shape and having an even number of sides, half of the sides comprising first sides adjacent one another at a first end of the floor and the other half of the sides comprising second sides adjacent one another at a second end of the floor;
  - a plurality of walls, each extending upwardly from a respective one of the first sides to a top end substantially in alignment with the top end of adjacent walls; and
  - a plurality of mounting members each being arranged to connect one of the second sides of the modular unit to one of the sides of an adjacent one of the modular units;
- at least some of the units having a communicating aperture in at least one wall thereof arranged to permit communication of the object therethrough;
- whereby connecting each modular unit to at least one adjacent one of the modular units forms a level of a maze structure.

The modular units each preferably have similar dimensions so as to be arranged to permit nested stacking of the modular units when the modular units are separated from one another. This is particularly useful for shipping or storage to reduce the amount of space occupied when the units are nested one inside the other.

Each modular unit is preferably square having walls on two adjacent sides thereof, but any polygonal shape having an even number of sides, for example a hexagon or octagon, would also be useful. In the instance of a hexagonal shaped floor having six equal sides, walls would extend upwardly from three adjacent sides of the floor. The modular units would thus remain capable of nesting for storage.

The modular units are preferably formed of rigid material so as to permit stacking of one level of modular units above another. This may includes rigid wall panels or a rigid frame supporting wall panel of lighter material thereon. At least some of the modular units preferably have a communicating aperture in the floor thereof arranged to permit communication of the object therethrough. The is useful when stacking one level above another for communicating the object between the levels.

As described above, the maze structure may be arranged for passage of a person therethrough. The floor of each modular unit is thus preferably arranged to support the person thereon with the communicating apertures all preferably being suitably sized to permit communication of the person therethrough.

BRIEF DESCRIPTION OF THE DRAWINGS

In the accompanying drawings, which illustrate exemplary embodiments of the present invention.

DETAILED DESCRIPTION

Figure 1:
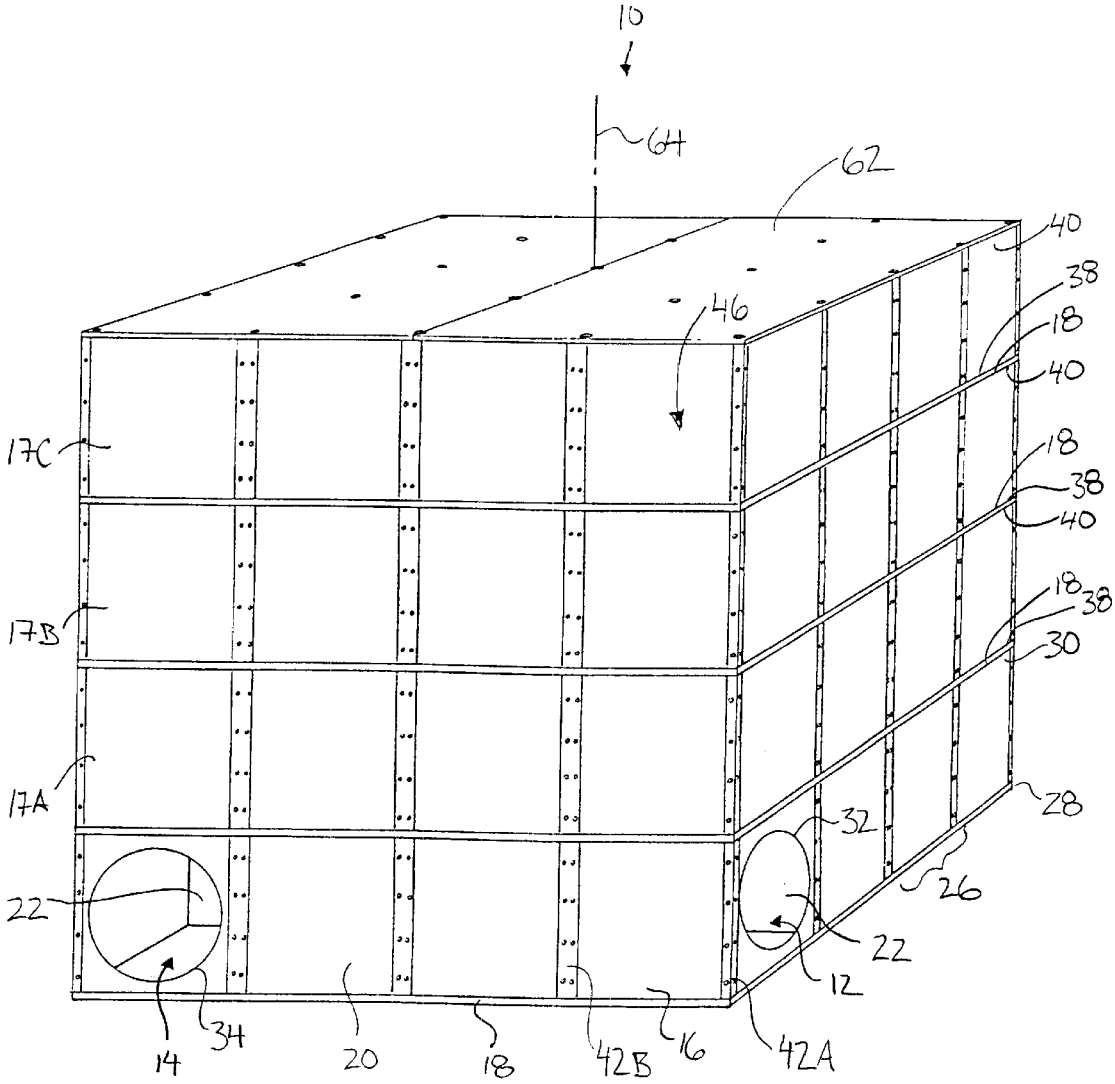
FIG. 1 is an isometric view of an assembled maze structure.

Referring initially to FIGS. 1 through 8 there is illustrated a first embodiment of a maze structure generally indicated by reference numeral 10. The maze structure 10 is an amusement device having a plurality of diverging paths formed therein between an entrance 12 and an exit 14 thereof.

The first embodiment of the maze structure 10 is scaled for passage of persons therethrough. Being modular in construction, the maze structure 10 permits rearrangement thereof so as to produce different arrangements of the paths between the entrance and exit. The modular components of the maze structure include a base level 16 and a plurality of stacking levels 17A, 17B and 17C which are arranged to be supported one atop the other as illustrated in FIG. 1.

Each level includes a floor 18 which is square when viewed from above. An exterior wall 20 extends upwardly from each side of the floor 18 adjacent a periphery thereof so as to define a perimeter of the level.

Each of the levels includes a square grid on the floor thereof upon which interior walls 22 are to be aligned and mounted. Any number of interior walls 22 may be used to separate each level into a plurality of separate chambers 24 which are restricted from communicating with adjacent chambers by the interior walls 22 confined within the perimeter of the exterior walls 20. The grid on the floor 18 of each level separates the floor into a plurality of square cells 26 such that aligning the interior walls with the grid results in each chamber being formed by a plurality of the cells 26 which are interconnected.

The floor 18 of the base level 16 spans across the entire bottom 28 of the base level. Both the interior and exterior walls extend upwardly from the floor to an open top end 30 of the base level. An entrance aperture 32 and an exit aperture 34 are both located within the exterior walls 20 of the base level. The entrance and exit apertures are each arranged to be in communication with a separate one of the chambers 24 of the base level such that there is no direct communication between the entrance and the exit on the base level, but rather interaction between the floors is required to navigate from the entrance to the exit. Each of the entrance and exit apertures is completely contained within a single cell 26 of the base level.

The floor 18 of each stacking level includes a plurality of communicating apertures 36 therein. Each of the communicating apertures 36 is contained within a single cell 26 of the level and is arranged to communicate between a respective chamber of the stacking level and a chamber of a level which is supported therebelow when the stacking levels are supported one on top of the other above the base level. Some of the chambers of each stacking level may be free of communicating apertures 36 while others may include one or more of the apertures 36 therein for communicating with more than one chamber in the level therebelow.

Similarly to the base level both the exterior and interior walls of each stacking level extend upwardly from a bottom end 38 of the stacking level to an open top end 40 of the level. The interior walls 22 are similarly arranged to define separate chambers 24 within each stacking level which are restricted from communicating with other chambers on that level by the interior walls. The open top end 40 of the stacking levels and the open top end 30 of the base level as well, permit the communicating apertures 36 to communicate with a chamber therebelow through the open top end of the level therebelow.

The exterior walls 20 and the interior walls 22 are supported on the respective floor 18 of the respective level of both the base level and the stacking levels by a plurality of mounting posts 42. Each mounting post 42 is arranged to be mounted at a respective intersection point 44 of the respective rectangular grids on each floor 18. Each of the walls is formed by a wall panel 46 which is arranged to be mounted between a selected pair of the mounting posts 42.

Each mounting post 42 includes a core 48 which extends longitudinally through a center of the post and a plurality of mounting channels 50 which extend radially outward from the core 48 at right angles to one each other for mounting a side of one of the wall panels 46 thereon. The mounting channels 50 each comprise a pair of mounting flanges which are parallel and spaced apart for receiving the side of the respective wall panel 46 therebetween. A plurality of bolts 52 are arranged to extend through co-operating apertures in the mounting flanges of the channels 50 and the side of the wall panel 46 for selectively mounting the side of the panel to the respective mounting post.

Figure 3A:
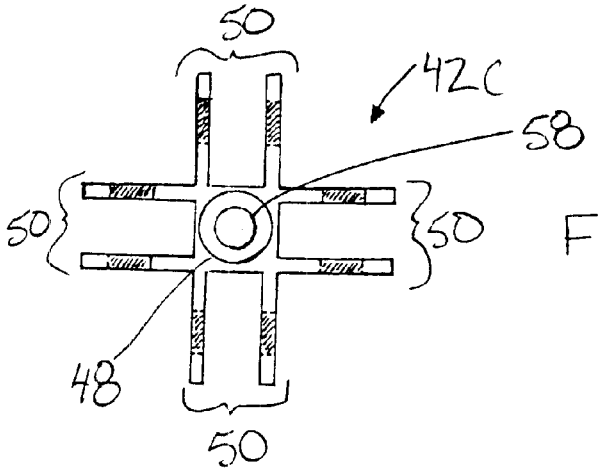
FIGS. 3A and 3B are respective side elevational and top plan views of one embodiment of a post for mounting the interior walls of each level on the respective floor of the levels of the maze structure according to FIG. 1.
Figure 3B:
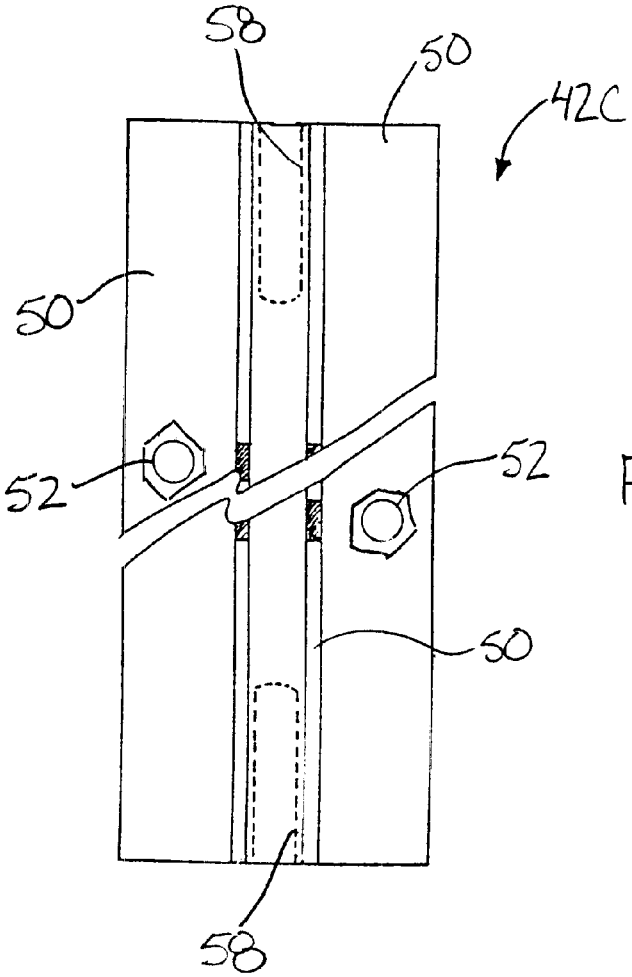
Figure 4:
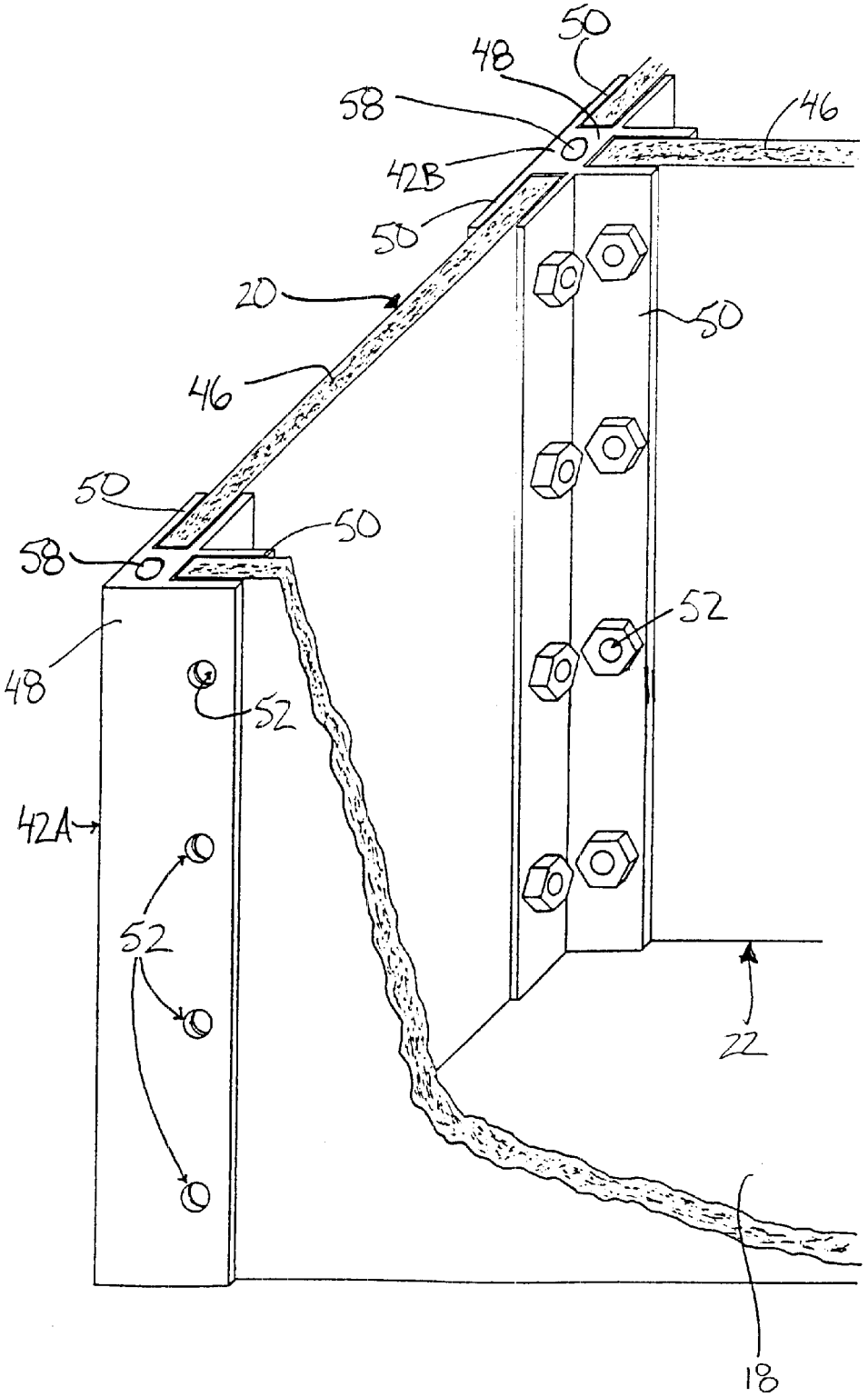
FIG. 4 is a partly sectional isometric view of a corner portion of one of the levels of the maze structure according to FIG. 1.

The mounting posts 42 include various configurations depending upon their location on the respective grid of the respective level. As illustrated in FIG. 4 in a corner post arrangement 42A only two mounting channels 50 are provided at right angles to each other, while in a perimeter configuration 42B the mounting post includes three mounting channels 50 at right angles to each other for mounting two wall panels 46 of the exterior wall 20 and one wall panel 46 of the interior wall 22 thereon. Within the perimeter of each level the mounting post 42 will generally assume the interior configuration 42C as illustrated in FIGS. 3A and 3B.

Figure 2:
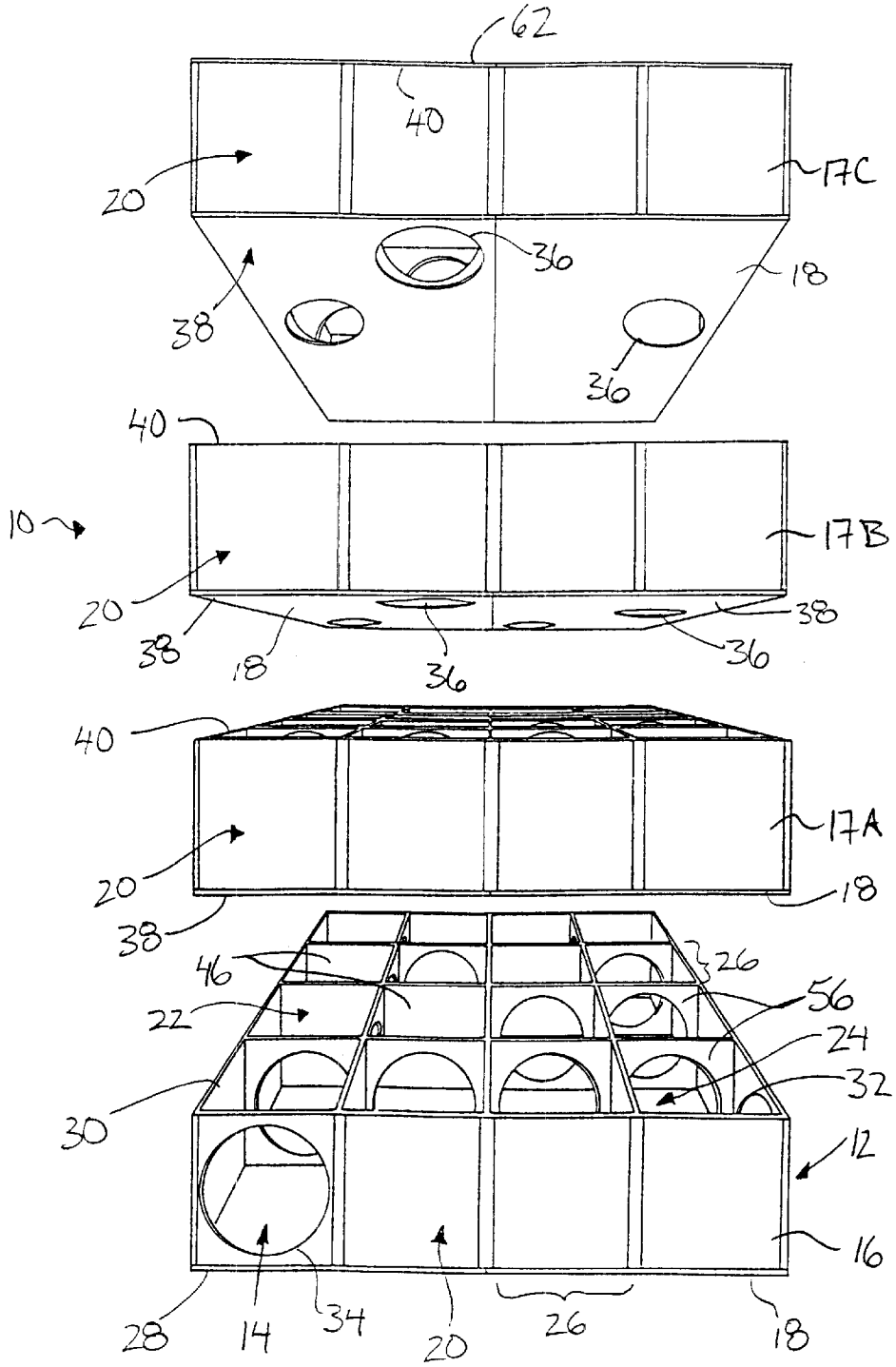
FIG. 2 is an exploded perspective view of the maze structure according to FIG. 1 showing the levels of the maze structure separated from one another.

The wall panels 46 of both the interior and exterior walls of all levels, are all square and of the same dimensions such that any wall panel may be fitted between any two mounting posts 42 resulting in various wall mounting positions, each of which produces a new path to be navigated through the maze structure. The wall panels 46 may be formed of opaque materials or translucent materials depending upon the desired appearance and level of difficulty of the maze structure. In some embodiments a partial wall panel 56 is mounted between adjacent cells 26 which form part of the same chamber 24 of a given level. The partial wall panel 56 as illustrated in FIG. 2 includes an aperture therein so as not to obstruct passage through the chamber, while providing some structural support or an added obstacle to the passage through each respective chamber. Each partial wall panel 56 is mounted between a pair of mounting posts 42 in a similar manner to the wall panels 46.

Figure 5:
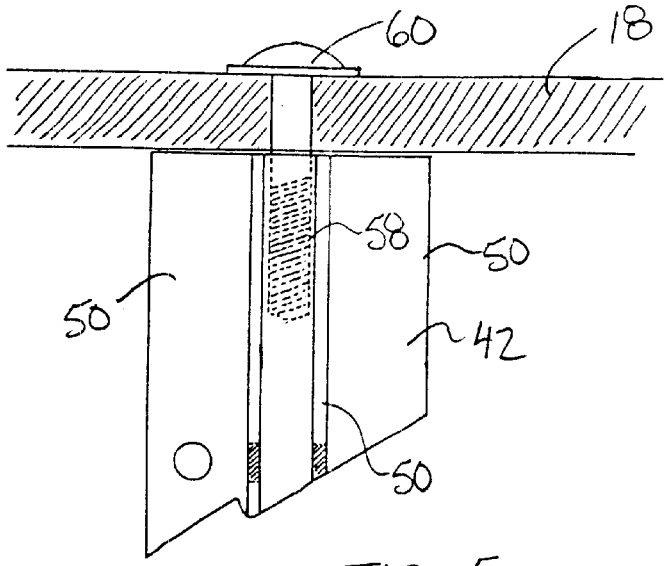
FIG. 5 is a sectional side elevational view of one of the posts according to FIGS. 3A and 3B shown mounted on the floor of a respective level.
Figure 6:
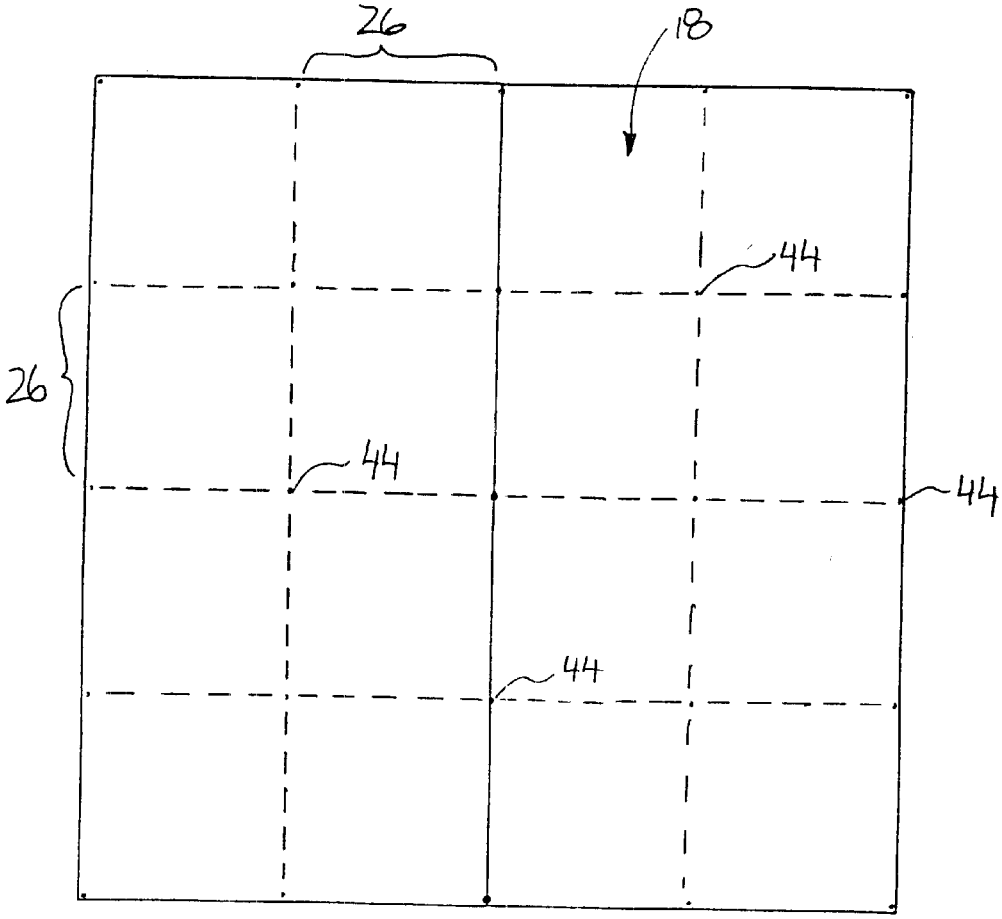
FIG. 6 is a bottom plan view of one of the levels of the maze structure according to FIG. 1 showing the intersection points of a grid thereon.

Each mounting post 42 includes a pair of threaded bores 58 which extend inwardly from respective ends of the mounting post in a longitudinal direction of the post for receiving a mounting bolt 60 therein. As illustrated in FIG. 5 the mounting bolt when inserted through an aperture at an intersection point on the grid of a respective floor 18 of one of the levels, permits the respective mounting post 42 to be secured to the floor 18. The threaded bores 58 may also be used for securing adjacent levels together or for securing a cover 62 on an uppermost one of the levels when stacked one atop the other. The cover 62 is a solid panel which may be formed in sections and has overall dimensions substantially equal to each of the floors 18 of the respective levels. When three stacking levels are used in combination with the base level the square dimension of the cover 62 are substantially equal to any given side of the maze structure 10 such that the maze structure is generally cubic in shape.

In use the stacking levels 17A, 17B and 17C are stacked one on top of the other on top of the base level 16 to form the cube illustrated in FIG. 1. The stacking orientation of the stacking levels may be varied as desired resulting in numerous different solutions to the maze structure. The different stacking orientations include changing the stacking order of the stacking levels as well as varying the angular position of one or more of the stacking levels in relation to the base level about a vertical axis 64 extending centrally through the levels. As the levels are square having four sides each stacking level may be rotated into one of four angular positions in which the sides of the stacking levels are aligned with the sides of the base level in each position. Because of the open top of the base level and the stacking levels the communicating apertures 36 of the stacking levels are arranged to communicate with a chamber therebelow through the open top end of the level therebelow regardless of the stacking orientation.

The grid on each floor 18 of each level is square and divides the floor into sixteen equal sized cells 26. The height of each level is approximately equal to the spacing of the grid of each level such that the four levels combined forms a cube having sixty-four cubic units with which to form the paths from the entrance to the exit of the maze as desired. In one embodiment the interior walls and the stacking orientation of the stacking levels are arranged such that the cubic units form continuous paths from the entrance to the exit with no paths diverging therefrom.

When formed of proper materials and scaled for use by persons, the maze structure is self-supporting with the apertures and chambers all being suitably sized for receiving persons therethrough and being suitably arranged for supporting the persons on any given level.

Figure 9:
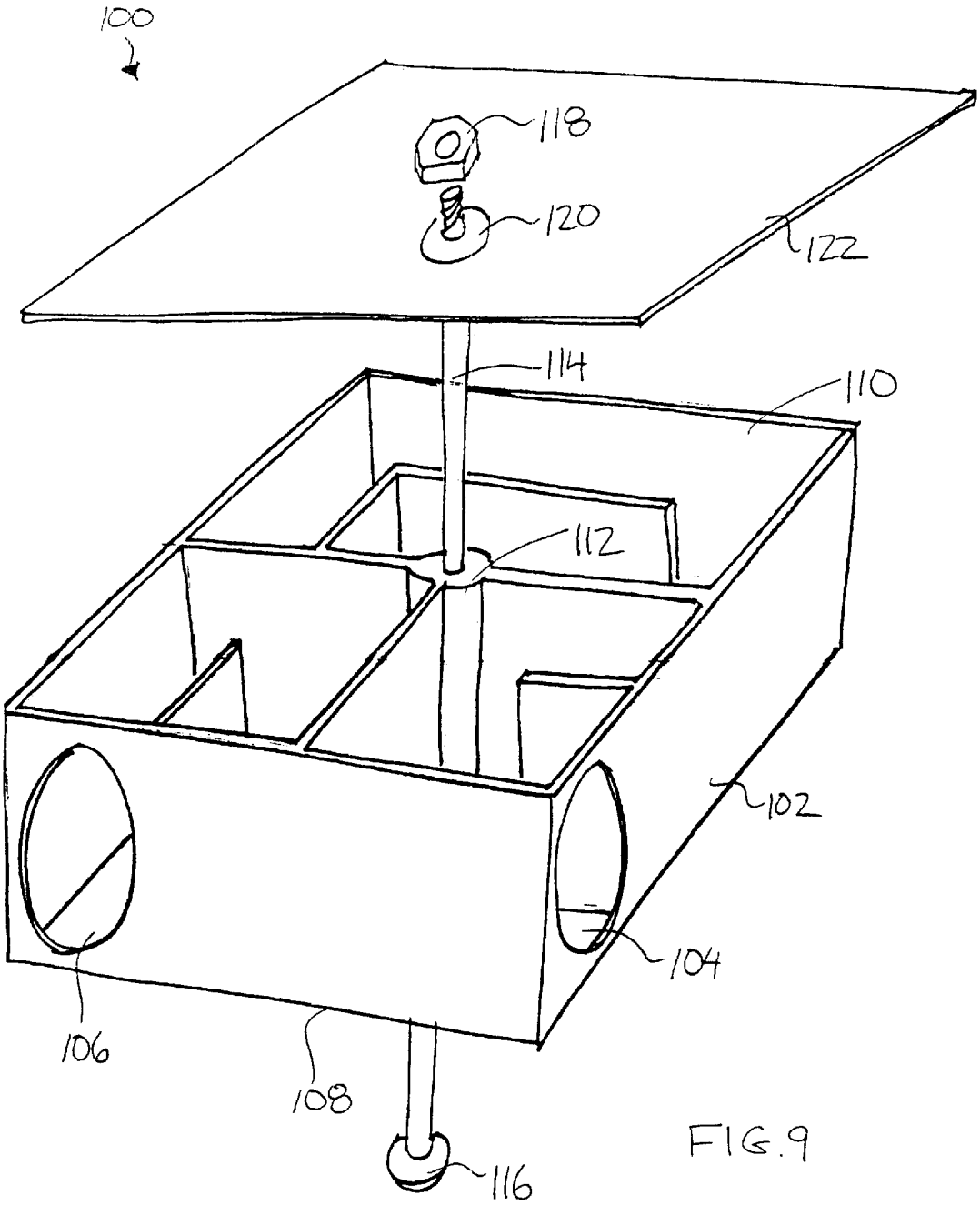
FIG. 9 is an isometric view of a base level, cover and mounting arrangement of an alternative embodiment of the maze structure.

In a further embodiment as illustrated in FIG. 9, the maze structure 10 may be appropriately scaled so as to be handled by a person for guiding a maze ball through the maze structure from the entrance to the exit thereof. In the handheld embodiment of FIG. 9, the walls of the chambers 24 of each level are preferably smooth in construction so as not to interfere with a maze ball rolling through the maze structure 100. The maze structure 100 includes a base level 102 and a plurality of stacking levels which are not shown. The base level is similarly arranged as in the first embodiment having an entrance 104 and an exit 106. As in the previous embodiment the base level includes a solid floor 108 and an open top end 110 which is arranged to communicate with apertures in the floor of a stacking level supported thereabove. Each level preferably includes an upright sleeve 112 which is mounted at the center of the level in alignment with sleeves of adjacent levels for receiving a mounting rod 114 therethrough for securing the levels together. One end of the mounting rod 114 includes a bolt head 116 thereon while the opposing end is threaded for receiving a nut 118 thereon for clamping the levels therebetween when the nut is secured on the end of the mounting rod. The use of washers 120 at each end of the mounting rod 114 permits the levels to be clamped together while permitting relative rotation of each level in relation to the base level between one of four angular positions about a longitudinal axis of the mounting rod. A cover 122 having similar dimensions to the floor 108 of the base is secured across an open top end of an uppermost one of the stacking levels which is not shown. The cover also includes an aperture located centrally therein for receiving the mounting rod 114 therethrough. In use the solution of the maze from the entrance to the exit can be varied by rotating any one of the stacking levels in relation to the base level about the longitudinal axis of the mounting rod. If further variation is desired the nut 118 may be removed from the mounting rod permitting the stacking levels to be removed from the mounting rod as well and then reassembled again in a different order.

The maze structure in both the handheld embodiment or the first embodiment scaled for persons, consists of four levels and a top, but any number of levels may be used to result in a maze structure having the benefits of multiple stacking orientations as described herein.

In order to construct the first embodiment, the cover 62 may be formed of two sheets of 4 foot by 8 foot plywood which is preferably ¾ of an inch thick. Two sheets are place side by side along the long narrow edge in the same plain to form the square cover. Similarly to the cover 62, the floor 18 of each level may be created by bringing two 4 foot by 8 foot sheets of plywood together along the 8 foot narrow edge in the same plain.

Each of the wall panels 46 of the exterior wall is preferably a 2 foot by 2 foot sheet of ½ inch thick plywood connected to the floor with the use of the mounting posts 42 preferably formed of suitable metal, for example aluminium. Bolts, with washer and nut added, pass through the flanges of the mounting channels 50 and the respective wall panels formed of plywood to fix these elements in place.

Each of the wall panels 46 of the interior walls can also be made from sheets of plywood that are 2 foot by 2 foot. They are joined to the sides and/or other walls in such a way that the grid is created. Grid cells are all 2 feet wide and 2 feet long. To allow movement through the, some of the grid, some of the wall panels 46 are replaced with partial wall panels 56. The exit and entrance apertures have a radius of approximately 10½ inches and are cut in two sides of the base level. This allows access to two chambers 24 of the base level. The apertures are cut so that they are completely contained within one cell of the grid or cubic unit of the maze structure and do not overlap into any other cells.

The communicating apertures 36 each have a radius which is approximately 10½ inches and are each cut in the floor 18 of the respective stacking level. These apertures allow access to a cell of the grid of the level which is supported therebelow. The apertures are also completely contained in one cell of the grid and do not overlap into any other cells.

The maze structure combines elements of the classic maze with that of exploring caves, without the danger of a cave, while still giving the user a sense of moving through a tunnel. The modular construction of the maze structure provides a portable maze which can be set up outdoors or indoors. The juxtapositions of levels can be changed so that hundreds of different mazes can be easily formed including long or short, simple or complex paths through the maze from the entrance to the exit of the maze.

In the first embodiment scaled for passage of persons therethrough, the structure can be assembled so as to prevent or allow various amounts of light using wall panels of different properties. The maze structure can also be arranged to present one long tunnel or mazes of varying lengths and complexity.

Figure 7:
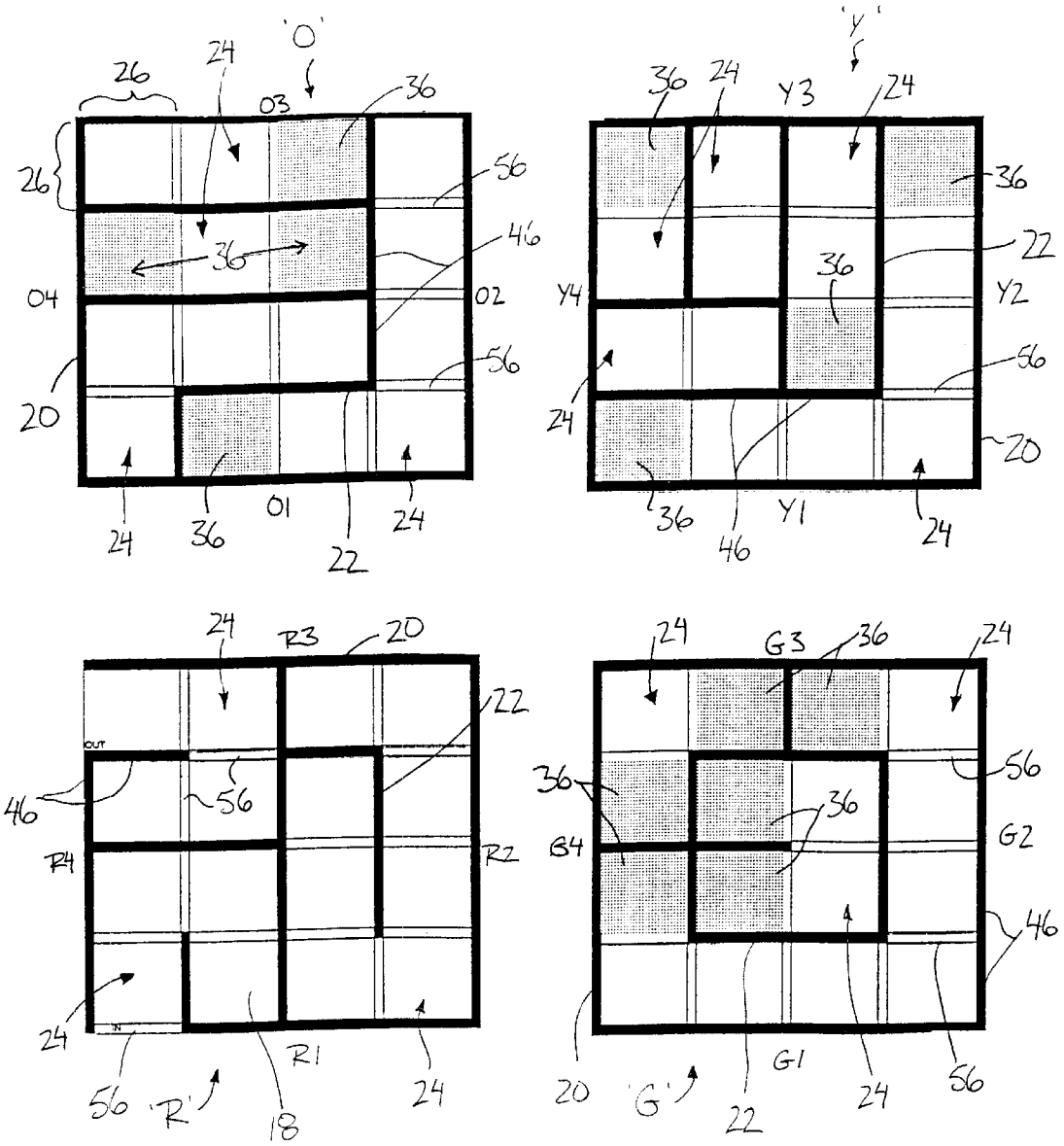
FIG. 7 is a top plan view of the levels of the maze structure according to FIG. 1 shown separated from one another and arranged to be supported in a first stacking orientation.
Figure 8:
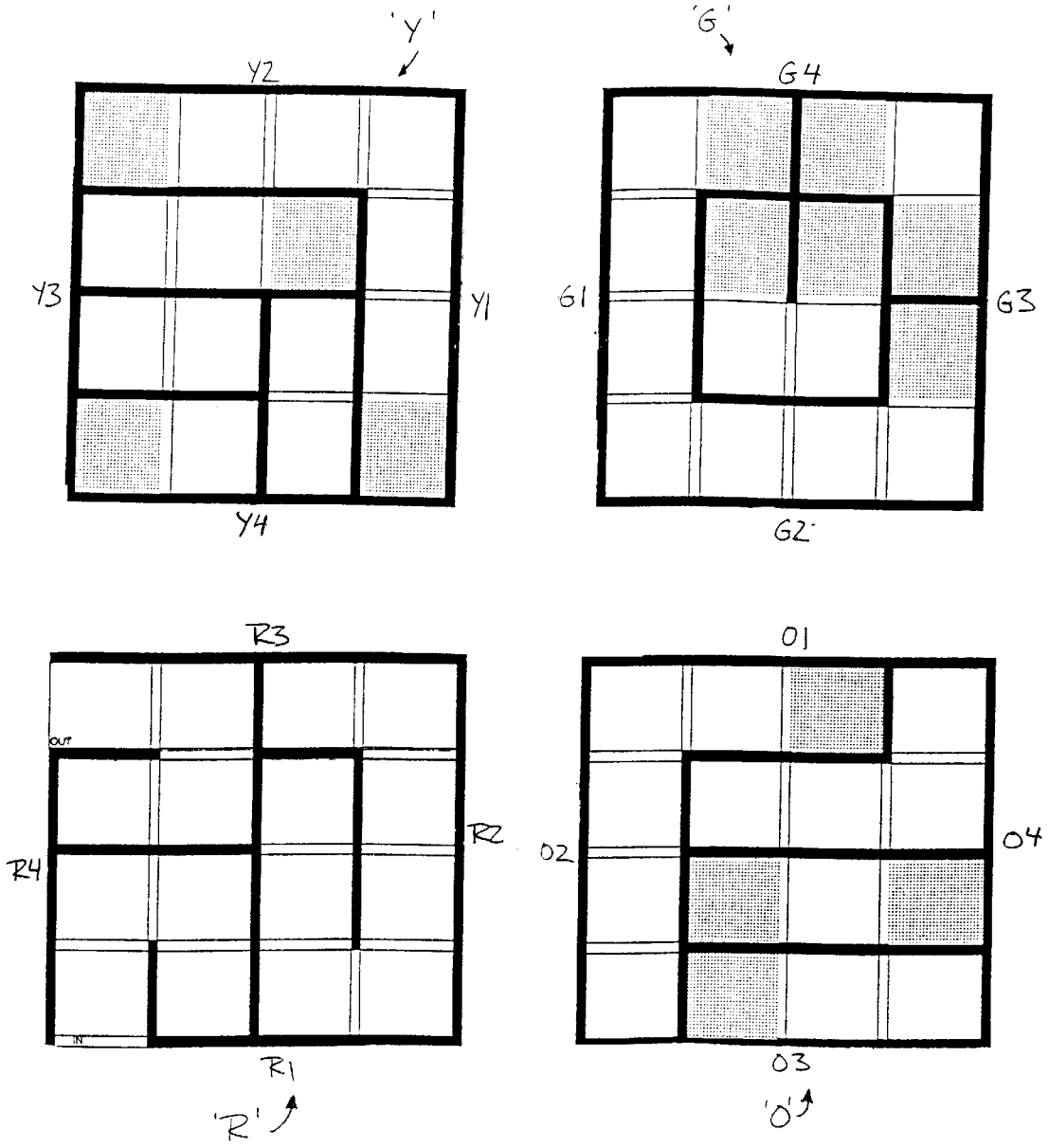
FIG. 8 is a top plan view similar to FIG. 7 with the levels arranged to be supported in one of plural alternative stacking orientations from that of FIG. 7.

FIG. 7 shows a diagram of one possible floor plan of the four levels. Exterior sides are labelled on each of the levels as illustrated in FIG. 7 and FIG. 8. The base level is designated by reference character R with sides R1, R2, R3 and R4. The stacking levels are designated O, Y and G respectively with corresponding designations for their respective sides being similar to the base level. When the levels are stacked to form a cube, so that side G1 is immediately above Y1 which is immediately above O1 which is immediately above the base level's side R1, the structure forms one continuous tunnel, with no dead-ends or detours. This is designated as route R1-O1-Y1-G1.

FIG. 8 shows a different stacking orientation with the stacking level designated O being supported on the top of the stack and the each of the stacking levels being rotated about the vertical axis into an alternate angular position to achieve the route designated R1-Y4-G2-O3. In this case the structure forms a long maze with several dead-ends, detours but no solution from egress to access.

With the configuration of the levels arranged as illustrated in FIGS. 7 and 8, using two, three or all four levels at a time, and utilising all the various permutations and combinations as many as 491 mazes and one tunnel can be created. Repositioning the wall panels 46 and interchanging them with partial wall panels 56, as well as repositioning the communicating apertures in the floors as permitted by the simple construction of the maze structure which uses selectively separable fasteners, the variations to the path of the maze are almost limitless.

Other embodiments could have the entrance and exit on different levels. By replacing the wall panels 46 of the exterior walls with partial wall panels 56 permitting passage therethrough, levels could be placed side by side as well as on top of each other.

The structure does not have to be limited to four levels, nor must the grid be limited to a four by four configuration. Levels could have a smaller or larger number of grid sections. For example, instead of the described four by four, there could be three by four or five by five.

The maze structure 10 provides a unique activity/play structure. This three-dimensional activity/play structure for adults and children according to the first embodiment is formed of a plurality of modular levels which, when combined, create a self-standing tunnel and tunnel maze. Levels above the base level are interchangeable and can be used in combination with other upper levels and/or just with the base. A level comprises a square base, four sides and interior walls.

Each level might comprise only some of the parts of the entire tunnel or maze. Holes in walls and in bases create routes within the structure that might or might not lead directly from access to egress. Various combinations and permutations of the standard levels and the proximity of their sides create completely different mazes. In addition parts of walls and bases are interchangeable thus creating completely different levels and, therefore, completely different sets of combinations and permutations. The structure is portable.

In the handheld embodiment, the size is preferably reduced to a cube measuring approximately 4 inches or 10 centimeters per side to form a toy maze. As illustrated in FIG. 9, the handheld embodiment also consist of four levels and a top. The levels are interchangeable and can be rotated about their horizontal centres.

The fastening device in the hand held embodiment may comprise a mounting rod as illustrated in FIG. 9 or in an alternative arrangement, a strong elastic band or bands.

One version of the maze structure is made using formed plastic (or other polymer), which is either transparent, translucent, opaque or any combination thereof. Other materials include wood or metal.

Figure 10:
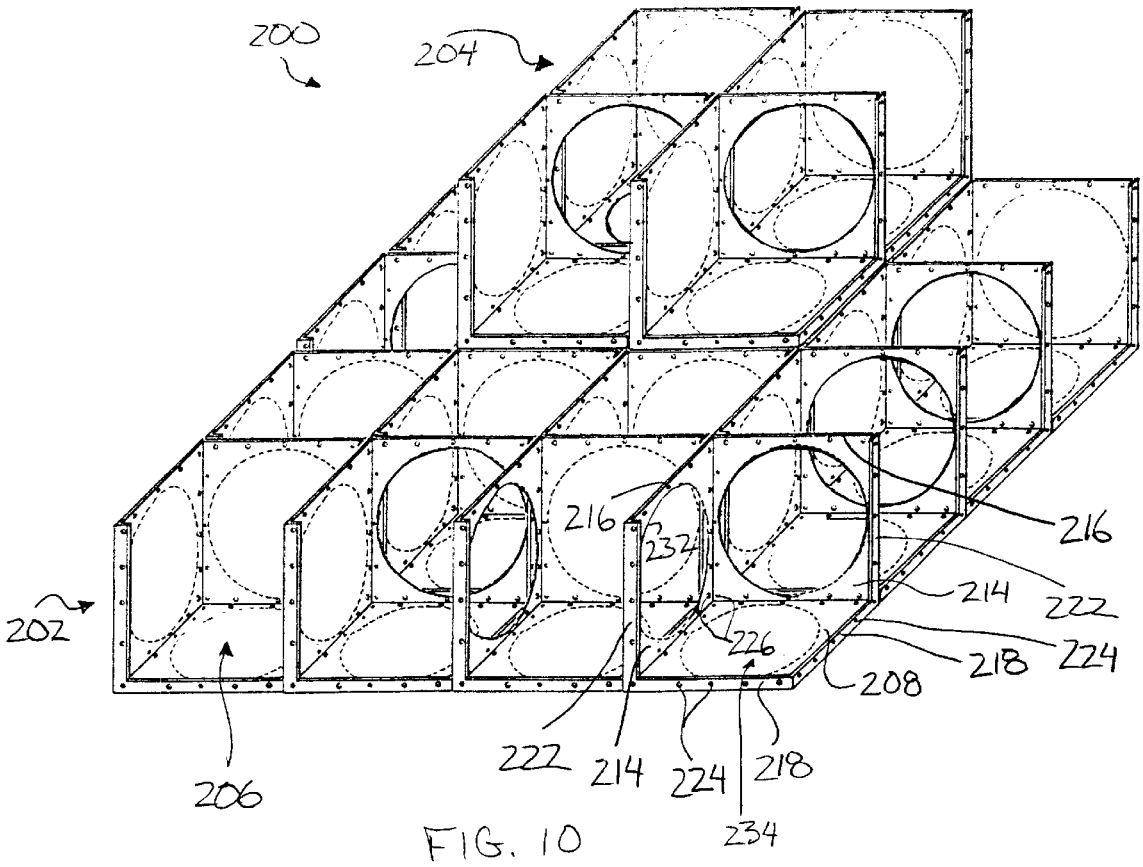
FIG. 10 is an isometric view of an alternative embodiment of the maze structure shown partially disassembled.
Figure 11:
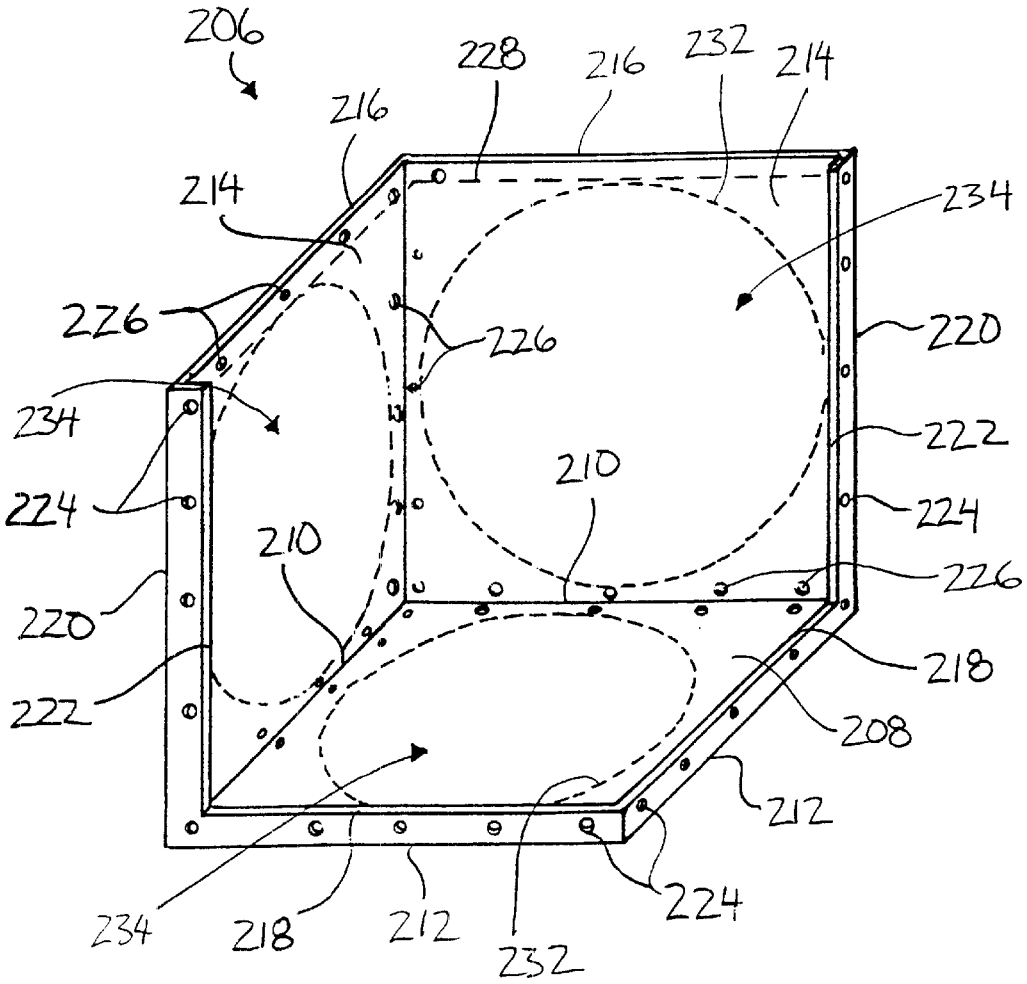
FIG. 11 is an isometric view of a single cell of the maze structure of FIG. 10.

A further embodiment of a maze structure 200 is illustrated in FIGS. 10 and 11. The maze structure 200 also includes a base level 202 and a plurality of stacking levels 204 (only one of which is partially shown) which are arranged to be supported one atop the other in various configurations similarly to the first embodiment. Each level also similarly includes a floor with interior and exterior walls extending upwardly therefrom.

Each level of the maze structure 200 is formed by a plurality of modular units 206 which are connected together to form the maze structure. Each modular unit 206 defines one of the cells of the corresponding level referred to hi above in regard to the first embodiment.

Each modular unit 206 includes a floor 208 which is square in shape having four sides. Among the sides of the floor 208 one pair thereof comprises first sides 210 adjacent one another at a first corner of the floor while the other pair of sides of the floor comprise second sides 212 adjacent one another at a second corner of the floor opposite the first corner.

A square wall 214 extends upwardly from each of the first sides 210 of the floor for partially enclosing the modular unit 206. The walls 214 are square having similar dimensions to the floor 208 such that the modular unit forms a cube. Each wall 214 thus extends upwardly to a top end 216 thereof which is aligned with the top end of the adjacent wall.

A pair of mounting flanges 218 extend upwardly from the respective second sides 212 of the floor and are used for mounting the floor along one side to the floor of an adjacent modular unit having a similar configuration. The flanges 218 extend upwardly from the second sides of the floor in alignment with the respective sides, parallel to the floor.

The upright free ends 220 of the walls 214 similarly include a mounting flange 222 thereon. The mounting flanges 222 each lie in a common plane with a corresponding one of the second sides 212 of the floor so as to extend perpendicularly outwardly from the respective wall 214.

Each of the mounting flanges 218 and 222 includes respective apertures 224 therein which are arranged for alignment and communication with mounting apertures 226 in the respective walls 214 of an adjacent modular unit 206 having a similar configuration. Insertion of appropriate fasteners through the cooperating apertures 224 and 226 enables the modular units to be connected to one another.

When stacking levels one on top of the other an additional mounting flange indicated in dotted line at 228 in FIG. 11 may be provided for connection to the floor of a modular unit situated thereabove. The additional flange 228 extends laterally outwardly from the top end 216 of each wall 214 and would include apertures therein for communication and alignment with apertures in the floor 208 of a modular unit situated thereabove for similarly receiving fasteners therethrough as described above.

Each modular unit 206 is formed of rigid material so as to permit stacking of the levels formed by the units with the floor of each modular unit being suitably sized and arranged for supporting a person thereon. In a preferred arrangement each modular unit may be molded as a single unit. Dimensions of the units 206 are similar to each other such that the units are well suited for alignment with one another when forming levels of the maze structure while also being suitably arranged for stacking in a nested arrangement for storage.

When a level of the maze structure is formed of modular units at least some of the walls and floors of the modular units preferably include a communicating aperture 232 therein so as to permit communication of a person therethrough from one cell of the maze structure, defined by a first modular unit 206, to a second adjacent cell formed by a second modular unit 206 within the assembled maze structure.

The communicating apertures 232 may be permanently formed in each of the walls and floor of each modular unit 206 with a cover 234 being arranged to selectively cover each communicating aperture 232 as desired. The cover 234 may be formed in each respective floor and wall by perforations therein such that the cover may be broken free to reveal the respective communicating aperture 232, or in an alternative arrangement selective mounting members may be provided for selectively mounting each cover 234 within the respective communicating aperture 232 in such a manner that the cover may be removed and reattached selectively as desired.

While various embodiments of the present invention have been described in the foregoing, it is to be understood that other embodiments are possible within the scope of the invention. The invention is to be considered limited solely by the scope of the appended claims.

What is claimed is:

1. A maze structure including:

an end level comprising:

a first end surface;

a plurality of exterior walls extending outwardly in a generally perpendicular direction from the first end surface of the end level adjacent a periphery of the first end surface defining a perimeter of the end level;

a plurality of interior walls extending outwardly in the generally perpendicular direction from the first end surface of the end level within the perimeter defined by the exterior walls of the end level, the interior walls dividing the end level into a plurality of chambers; and a second end opposite the first end surface which is at least partially open;

at least one stacking level comprising:

a first end surface:

a plurality of exterior walls extending outwardly in a generally perpendicular direction from the first end surface of the stacking level adjacent a periphery of the first end surface defining a perimeter of the stacking level;

a plurality of interior walls extending outwardly in the generally perpendicular direction from the first end surface of the stacking level within the perimeter defined by the exterior walls of the stacking level, the interior walls dividing the stacking level into a plurality of chambers; and a second end opposite the first end surface which is at least partially open;

the first end surface of the stacking level including a plurality of apertures therein, each being arranged to communicate between one of the chambers of the stacking level and one of the chambers of a level supported adjacent thereto through the at least partially open second end of said level supported adjacent thereto;

said at least one stacking level being arranged to be supported on top of the end level with said at least one stacking level being arranged to be supported on an adjacent one of the levels in a plurality of relative stacking orientations therebetween with each of the apertures in the first end surface of said at least one stacking level being arranged to communicate with one of the chambers of said adjacent one of the levels through the at least partially open second end of said adjacent one of the levels in each of the plurality of stacking orientations;

the end surface of each level comprising a plurality of interconnected modular units which are selectively separable from one another, each modular unit having an end surface with side edges and at least one wall extending outwardly in the generally perpendicular direction from a respective one of the side edges thereof, each of the walls of the respective modular units forming part of the interior and exterior walls of the level.

2. The maze structure according to claim 1 wherein there is provided a plurality of stacking levels and each stacking orientation comprises a different order in which the stacking levels are supported one atop the other.

3. The maze structure according to claim 1 wherein each stacking orientation comprises a different angular position of said at least one stacking level in relation to the other levels with said at least one stacking level being rotated about a vertical axis extending through the levels between positions.

4. The maze structure according to claim 1 wherein the levels have similarly polygonal shaped first end surfaces which are similar in size, a length of each side of each first end surface being substantially equal to a length of the remaining sides.

5. The maze structure according to claim 4 wherein each first end surface is square.

6. The maze structure according to claim 5 wherein a combined height of the levels supported one atop the other is substantially equal to a width of one of the first end surfaces.

7. The maze structure according to claim 1 wherein each first end surface is generally rectangular in shape and wherein the interior walls are all mounted along a rectangular grid on the respective first end surface.

8. The maze structure according to claim 7 wherein the interior walls are selectively mounted on the respective first end surfaces of the levels such that the interior walls are moveable between various wall mounting positions along the rectangular grid on the respective floor.

9. The maze structure according to claim 1 wherein there is provided a cover arranged to be mounted on an uppermost one of the levels regardless of the stacking orientation of the levels.

10. The maze structure according to claim 1 wherein there is provided an entrance aperture through one of the exterior walls of a respective one of the levels and an exit aperture through one of the exterior walls of a respective one of the levels.

11. The maze structure according to claim 10 wherein the entrance aperture and the exit aperture are located on the same level.

12. The maze structure according to claim 11 wherein the entrance aperture and the exit aperture are both located on the end level.

13. The maze structure according to claim 11 wherein there is no communication between the entrance aperture and the exit aperture on the same level having the entrance and exit apertures therein.

14. The maze structure according to claim 10 wherein the maze structure, including the chambers and the apertures of the respective levels, are suitably sized to receive a person therethrough.

15. The maze structure according to claim 10 wherein the interior walls are arranged such that, in at least one of the stacking orientations, the chambers and the apertures communicating between chambers form a continuous tunnel from the entrance aperture to the exit aperture with no chambers or apertures diverging from the continuous tunnel.

16. The maze structure according to claim 1 wherein each chamber on any given level is restricted from communication with the other chambers on said given level by the interior walls.

17. A maze structure including:

a base level comprising:

a floor;

a plurality of exterior walls extending upwardly from the floor of the base level adjacent a periphery of the floor defining a perimeter of the base level;

a plurality of interior walls extending upwardly from the floor of the base level within the perimeter defined by the exterior walls of the base level, the interior walls dividing the base level into a plurality of chambers; and a top end which is at least partially open;

a plurality of stacking levels, each stacking level comprising:

a floor;

a plurality of exterior walls extending upwardly from the floor of the stacking level adjacent a periphery of the floor defining a perimeter of the stacking level;

a plurality of interior walls extending upwardly from the floor of the stacking level within the perimeter defined by the exterior walls of the stacking level, the interior walls dividing the stacking level into a plurality of chambers; and a top end which is at least partially open;

the floor of the stacking level including a plurality of apertures therein, each being arranged to communicate between one of the chambers of the stacking level and one of the chambers of an adjacent level supported therebelow through the at least partially open top end of said adjacent level;

the stacking levels being arranged to be supported one atop the other on top of the base level with each stacking level being arranged to be supported on an adjacent one of the levels therebelow in a plurality of relative stacking orientations therebetween with each of the apertures in the floor of the stacking level being arranged to communicate with one of the chambers of said adjacent one of the levels therebelow through the at least partially open top end of said adjacent one of the levels therebelow in each of the plurality of stacking orientations;

wherein each floor is generally rectangular in shape and wherein the interior walls are selectively mounted along a rectangular grid on the respective floor, each grid including a plurality of intersection points;

and wherein there is provided a post mounted on the respective floor to extend upwardly from each respective intersection point of the respective grids, the interior walls being selectively supported on the posts such that the interior walls are moveable between various wall mounting positions along the rectangular grid on the respective floor.

18. A maze structure including:

a base level comprising;

a floor;

a plurality of exterior walls extending upwardly from the floor of the base level adjacent a periphery of the floor defining a perimeter of the base level;

a plurality of interior walls extending upwardly from the floor of the base level within the perimeter defined by the exterior walls of the base level, the interior walls dividing the base level into a plurality of chambers; and a top end which is at least partially open;

a plurality of stacking levels, each stacking level comprising;

a floor:

a plurality of exterior walls extending upwardly from the floor of the stacking level adjacent a periphery of the floor defining a perimeter of the stacking level;

a plurality of interior walls extending upwardly from the floor of the stacking level within the perimeter defined by the exterior walls of the stacking level, the interior walls dividing the stacking level into a plurality of chambers; and a top end which is at least partially open;

the floor of the stacking level including a plurality of apertures therein, each being arranged to communicate between one of the chambers of the stacking level and one of the chambers of an adjacent level supported therebelow through the at least partially open top end of said adjacent level;

the stacking levels being arranged to be supported one atop the other on top of the base level with each stacking level being arranged to be supported on an adjacent one of the levels therebelow in a plurality of relative stacking orientations therebetween with each of the apertures in the floor of the stacking level being arranged to communicate with one of the chambers of said adjacent one of the levels therebelow through the at least partially open top end of said adjacent one of the levels therebelow in each of the plurality of stacking orientations;

a cover spanning the open too end of an uppermost one of the stacking levels; and a clamping mechanism securing the levels together, the maze structure being suitably sized to be handled by a person for guiding a maze ball through the maze structure.

19. The maze structure according to claim 18 wherein the clamping mechanism permits relative rotation of at least one of the stacking levels in relation to the other levels about a vertical axis extending centrally through the levels for displacement between the different stacking orientations.

20. A kit of parts for assembly into a maze structure for passage of an object therethrough, the kit comprising:

a plurality of modular units, each modular unit comprising;

a floor which is suitably sized for supporting the object thereon, the floor being an equilateral polygon in shape and having an even number of sides, half of the sides comprising first sides adjacent one another at a first end of the floor and the other half of the sides comprising second sides adjacent one another at a second end of the floor;

each of the first sides of the floor including a respective wall extending upwardly from the respective first side to a top end substantially in alignment with the top end of adjacent walls; and a plurality of mounting members each being arranged to connect one of the second sides of the modular unit to one of the sides of an adjacent one of the modular units;

at least some of the units having a communicating aperture in at least one wall thereof arranged to permit communication of the object therethrough;

whereby connecting each modular unit to at least one adjacent one of the modular units forms a level of a maze structure;

the modular units being formed of rigid material so as to permit stacking of one level of modular units above another and wherein at least some of the modular units have a communicating aperture in the floor thereof arranged to permit communication of the object therethrough.

21. The kit of parts according to claim 20 wherein the modular units each have similar dimensions so as to be arranged to permit nested stacking of the modular units when the modular units are separated from one another.

22. The kit of parts according to claim 20 wherein each modular units is square having walls on two adjacent sides thereof.

23. The kit of parts according to claim 20 wherein the maze structure is arranged for passage of a person therethrough such that the floor of each unit is arranged to support the person thereon and the communicating apertures are all suitably sized to permit communication of the person therethrough.

24. The kit of parts according to claim 20 for assembly into a maze structure wherein the object is a person.

25. The kit of parts according to claim 20 wherein the mounting members comprise flanges extending along open sides of the modular units for locating mounting apertures therein for connection to adjacent modular units using suitable fasteners.

* * * * *